US005862950A

United States Patent [19]

Holman

[11] Patent Number: 5,862,950

[45] Date of Patent: Jan. 26, 1999

[54] PISTON ASSEMBLY FOR TRIGGER SPRAYER

[75] Inventor: Dan E. Holman, Rutherfordton, N.C.

[73] Assignee: AFA Products, Inc., Forest City, N.C.

[21] Appl. No.: 790,164

[22] Filed: Jan. 29, 1997

[51] Int. Cl.[6] ..... B67D 5/40

[52] U.S. Cl. ..... 222/383.1; 222/385; 222/321.7; 222/321.9

[58] Field of Search ..... 222/383.1, 385, 222/321.7, 321.9

[56] References Cited

U.S. PATENT DOCUMENTS 2,547,109 4/1951 Bacheller ..... 222/321.9
4,105,146 8/1978 Broillard ..... 222/383.1
4,489,861 12/1984 Saito et al. ..... 222/383.1

*Primary Examiner*—David J. Walczak
*Assistant Examiner*—Timothy L. Maust
*Attorney, Agent, or Firm*—Thomas R. Vigil

[57] ABSTRACT

The trigger sprayer comprises a trigger sprayer body having a cylinder therein, a trigger movably mounted to the trigger sprayer body, and the improvement of a piston assembly including a piston body having an unobstructed annular space for receiving an O-ring and an O-ring mounted in the unobstructed annular space for sealing between the piston body and an inner wall in the cylinder in the trigger sprayer body.

Preferably, the piston body is formed from two parts which are pressed together to form the unobstructed annular space between the parts for receiving the O-ring.

17 Claims, 5 Drawing Sheets

PISTON ASSEMBLY FOR TRIGGER SPRAYER

BACKGROUND OF THE INVENTION

1. Field of the Invention

The present invention relates to a piston assembly comprising a piston having an unobstructed annular space for an O-ring and an O-ring received in the unobstructed annular space. The piston assembly is received in a cylinder of a trigger sprayer body and acted upon by a trigger movably mounted to the trigger sprayer body. To form the piston with an unobstructed annular space for receiving an O-ring, the piston is preferably made of two parts which are press-fitted together thereby forming an annular space between the two parts for receiving the O-ring.

2. Description of the Related Art Including Information Disclosed Under 37 CFR §§ 1.97–1.99.

Heretofore, trigger sprayers have been proposed which include a piston comprising a generally cylindrical piston body having a cylindrical cavity opening rearwardly of the piston body and a rubber or elastomeric, cup shaped insert received in the cavity and having on an outer periphery one or two lip seals which are generally frusto-conical in cross-section for engaging and sealing against an inside wall of a cylinder within which the piston is received. A piston of this type is illustrated in FIG. 1.

Such pistons with a cup shaped insert having one or two lip seals, typically made out of a rubber or elastomer have worked well. However, such inserts have been found to be expensive to produce. In this respect, the piston of the type shown in FIG. 1 costs between four and ten cents.

Furthermore, it has been found that a piston having lip seals made out of a rubber is not necessarily suitable for all kinds of liquids, particularly, cleaning fluids which are now being sold in containers having manually operated trigger type sprayers attached thereto for the dispensing cleaning fluid.

It has been known that an O-ring-type seal provides a good deflectable seal for a piston. However, when making a plastic one-piece piston, the molding is typically end to end such that flashing occurs. If an annular space is provide on such a piston for receiving an O-ring, the O-ring often will not make a good seal with the bottom or sides of the annular space for receiving the O-ring because of an axially and/or radially extending ridge caused by the flashing in molding the piston.

As will be described in greater detail hereinafter, the piston assembly of the present invention provides a piston assembly including an unobstructed annular space in a piston body for receiving an O-ring and an O-ring mounted in the annular space thereby providing an inexpensive piston assembly which is less expensive to manufacture and assemble than the present pistons with a lip seal or seals, which can be used with all kinds of liquids, and which provides a sealing member, namely the O-ring, made of different materials.

SUMMARY OF THE INVENTION

According to the present invention there is provided a trigger sprayer comprising a trigger sprayer body having a cylinder therein, a trigger movably mounted to the trigger sprayer body, and the improvement residing in a piston assembly including a piston body having an unobstructed annular space for receiving an O-ring and an O-ring mounted in the unobstructed annular space for sealing between the piston body and an inner wall in the cylinder in the trigger sprayer body.

Preferably, the piston body is formed from two parts which are pressed together to form the unobstructed annular space between the parts for receiving the O-ring.

DESCRIPTION OF THE PREFERRED EMBODIMENT(S)

Figure 1:
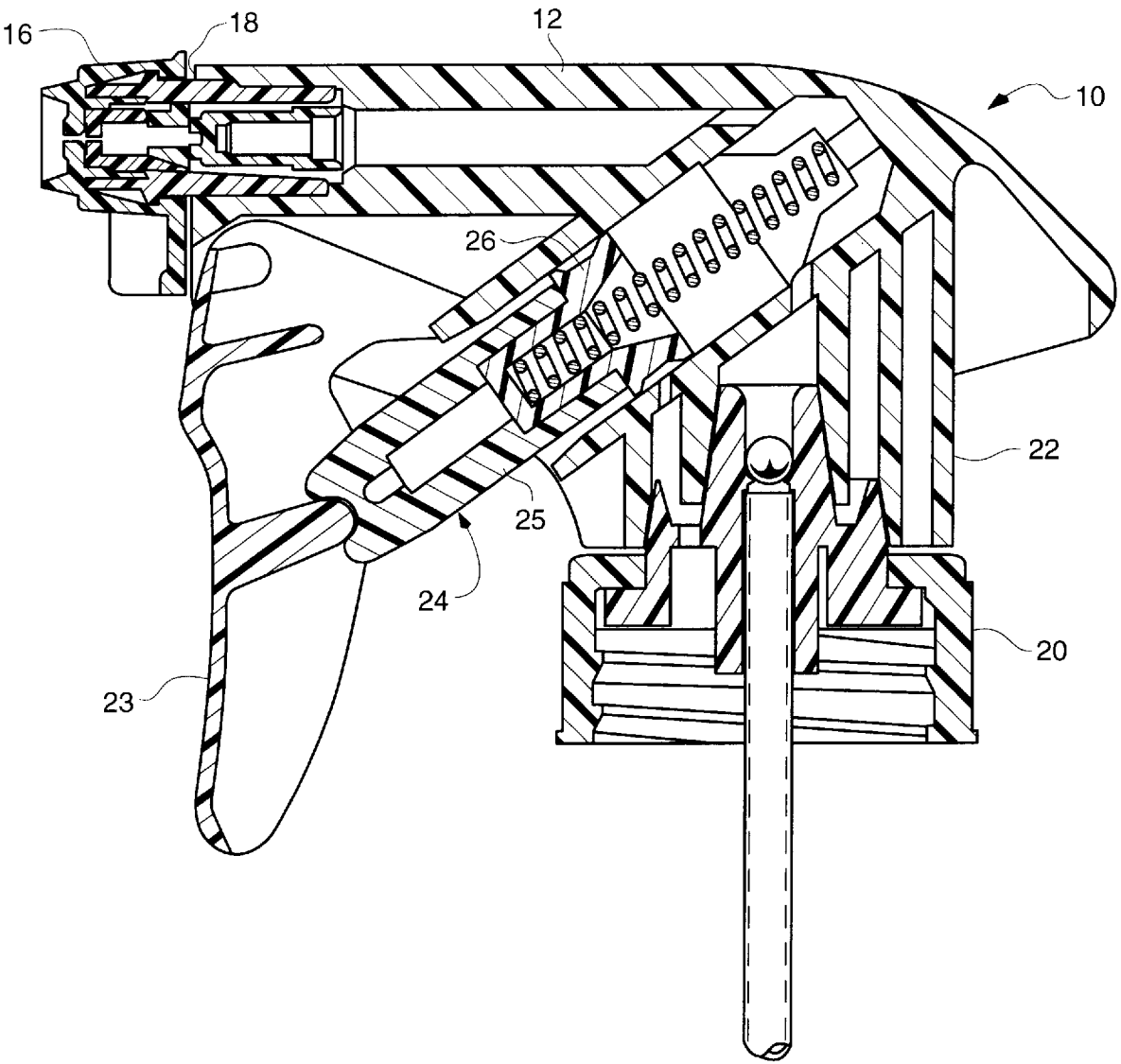
FIG. 1 PRIOR ART
FIG. 1 is a longitudinal cross sectional view of a prior art trigger sprayer.

Referring now to FIG. 1 there is illustrated therein a trigger sprayer 10 comprising a trigger sprayer body 12 having a cylinder 14 therein (FIG. 2), a nozzle 16 mounted to a front end 18 of the trigger sprayer body 12, a bottle cap 20 mounted to a lower end 22 of the trigger sprayer body 12, a trigger 23 movably mounted to the trigger sprayer body 12 and adapted to engage a piston assembly 24 which is received within the cylinder 14 (FIG. 2) and which includes a generally cylindrical piston body 25 having a cylindrical cavity opening rearwardly of the piston body 25 and a cup shaped rubber insert 26 received in the cavity and having a pair of spaced apart annular lip seals on an outer cylindrical periphery thereof .

Figure 2:
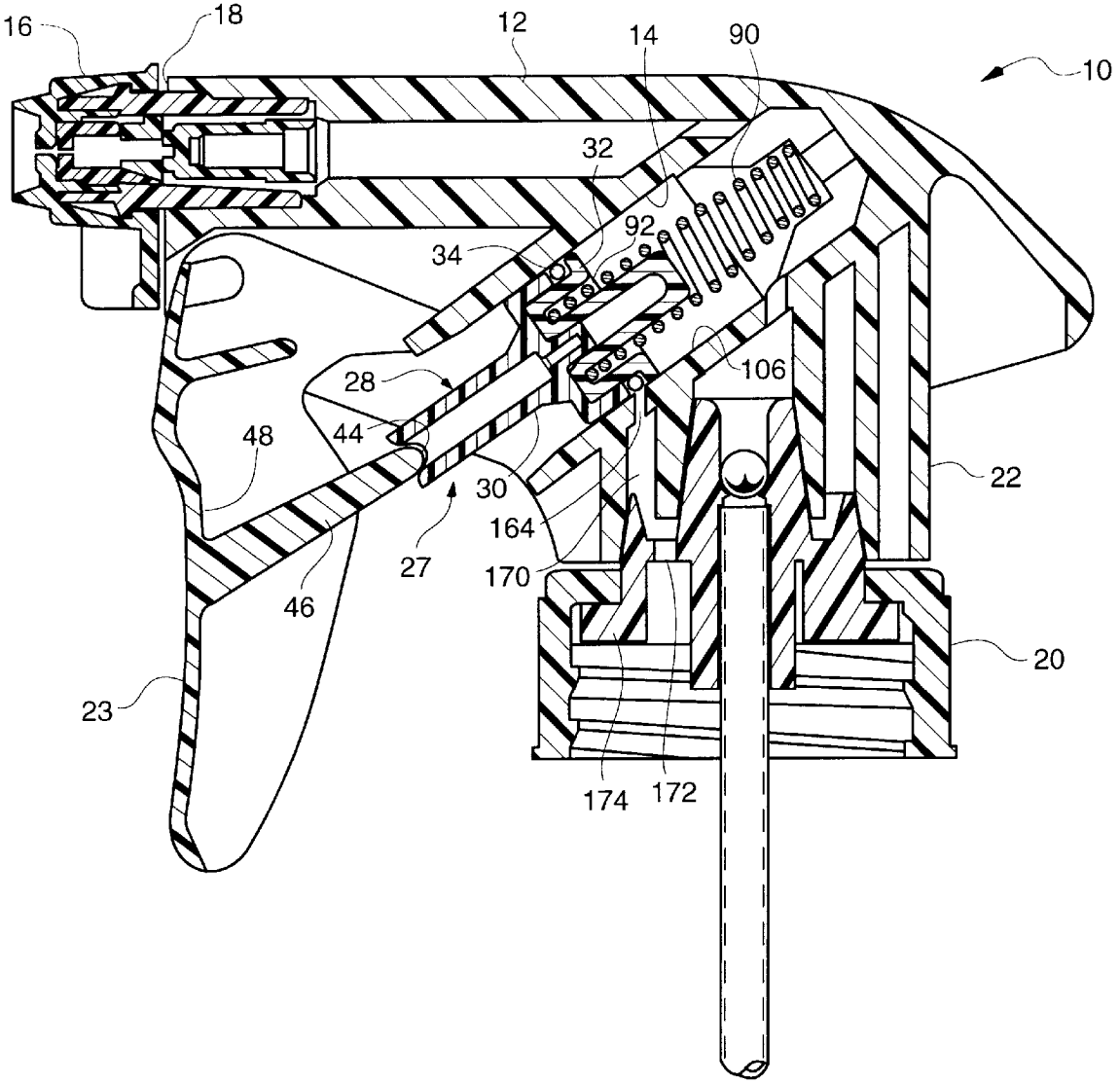
FIG. 2 is a longitudinal cross sectional view of the trigger sprayer shown in FIG. 1 but with the piston assembly therein replaced with a piston assembly constructed according to the teachings of the present invention.
Figure 3A:
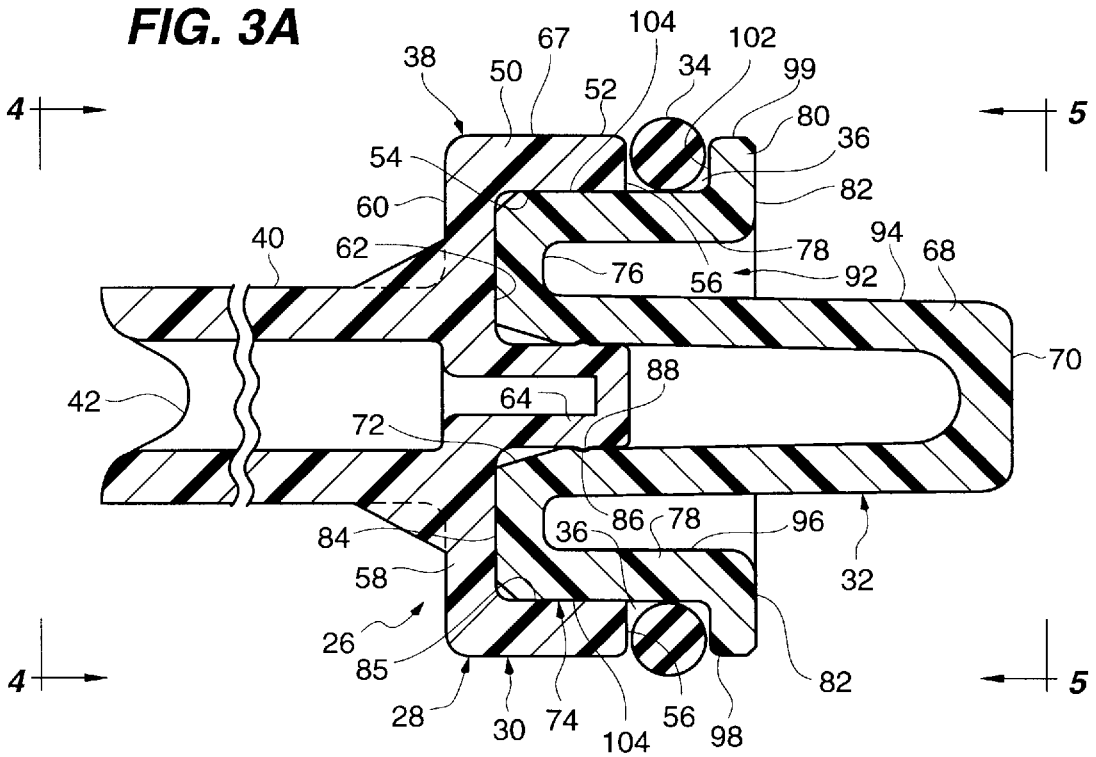
FIG. 3A is an enlarged view of the piston assembly constructed according to the teachings of the present invention which is also shown in FIG. 2.

As best shown in FIGS. 2 and 3A, a piston assembly 27 constructed according to the teachings of the present invention comprises a piston body 28 including an outer/forward part 30, an inner/rearward part 32 and an O-ring 34 disposed between the two parts 30 and 32 in an unobstructed annular space 36 defined between the parts 30 and 32 and is used in place of the piston assembly 24 shown in FIG. 1.

Figure 4:
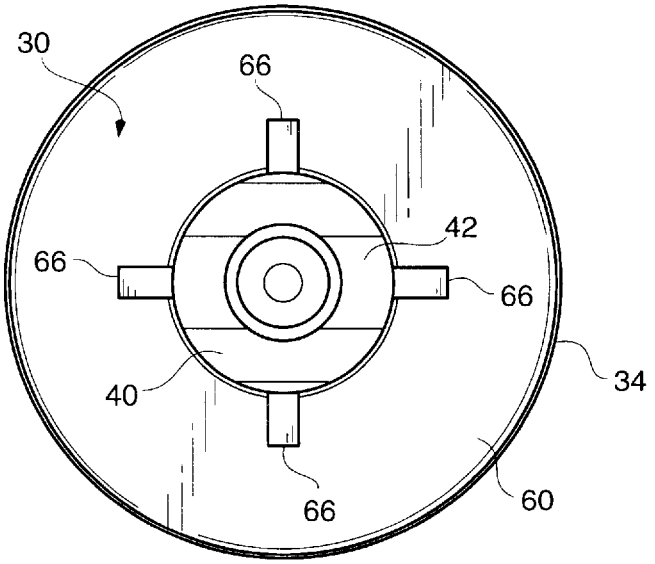
FIG. 4 is a front end view of the piston assembly shown in FIG. 3A and is taken along line 4—4 of FIG. 3A.
Figure 5:
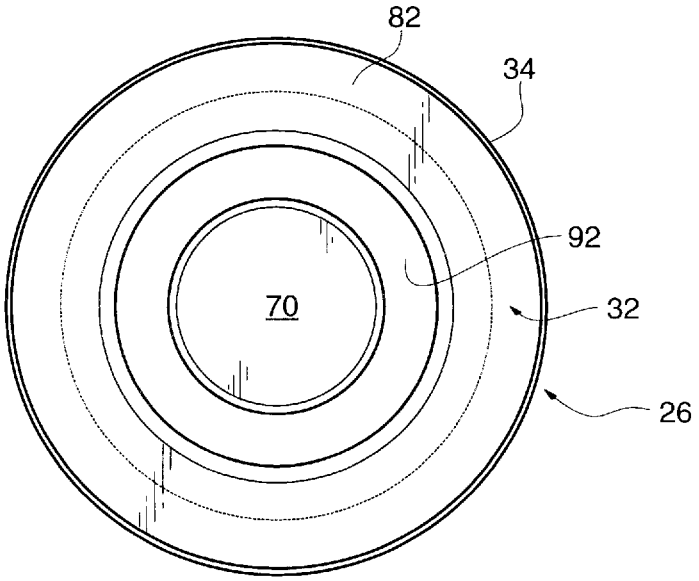
FIG. 5 is a back end view of the piston assembly shown in FIG. 3B and is taken along line 5—5 of FIG. 3A.
Figure 6:
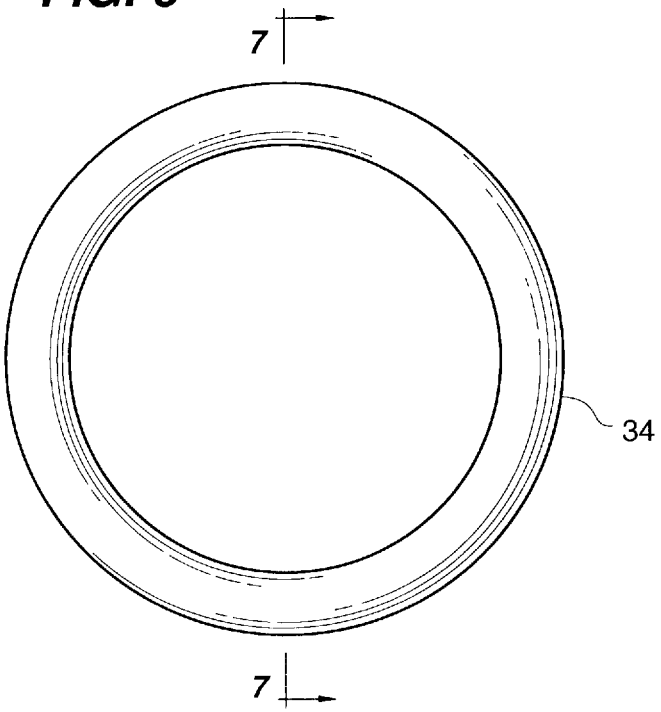
FIG. 6 is a plan view of the O-ring.
Figure 7:
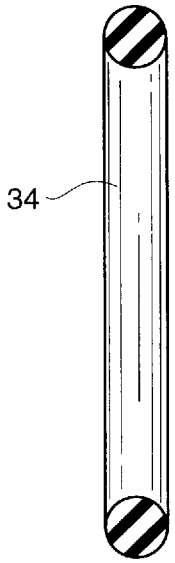
FIG. 7 is a cross-sectional view of the O-ring taken along line 7—7 of FIG. 6.

The outer/forward part 30 is generally cup shaped with a stem and includes a cup formation 38 and a forwardly extending stem or piston rod portion 40 having at it's outer end a curved, convex seat 42 for receiving a rounded end 44 (FIG. 2) of a strut 46 extending rearwardly from a backside 48 of the trigger 23. The cup formation 38 includes an outer cylinder 50 having an outer surface 52 an inner surface 54 and an annular, axially facing, free end surface 56. The cup formation 38 further includes an annular wall 58 which extends across the front of the cylinder 50 and has a forward surface 60 from which the piston rod portion 40 extends and a rearward surface 62 from the center of which extends, coaxially with the outer cylinder 50, an inner cylinder 64. The smaller-in-diameter inner cylinder 64 is opposite the piston rod portion 40 and extends rearwardly about the same axial distance as the outer cylinder 50. Four equidistantly spaced reinforcing ribs 66 (FIG. 4) extend forwardly from the forward surface 60 to and integral with the piston rod portion 40. The outer/forward part 30 is molded such that the mold separation is around the outer surface 52 of the outer cylinder 50 which has a diameter less than the inner diameter of the cylinder 14 in the trigger sprayer body 12. As a result, any flashing 67 on the outer surface 52 will not affect the operation of the piston body 28.

The piston body 28 further comprises the inner/rearward part 32 which is generally mushroom shaped including a hollow stem portion 68 closed at its rear end 70 and open at its forward end 72 for being received over the inner cylinder 64 of the part 30. An umbrella shaped cup or cap 74 extends radially outwardly from the forward end 72 of the stem portion 68 with a radially extending wall 76 that extends to an outer cylindrical wall 78 having a radially outwardly extending annular flange 80 at the axially facing free end 82 of the outer cylindrical wall 78.

An outer annular, axially forwardly facing, end surface 84 of the wall 76 confronts the axially rearwardly facing surface 62 of the radially extending wall 58 when the cap 74 is received into an annular space 85 formed in the cup formation 38 between the outer cylinder 50 and the inner cylinder 64. Preferably inner cylinder 64 has an annular bead or bumps 86 on an outer surface thereof for snap fittingly engaging in an annular groove 88 on the inner surface of the hollow stem portion 68 to hold the parts 30 and 32 together.

The stem portion 68 serves as a guide post for a spring 90 (FIG. 2 and 3A) positioned in the cylinder 14 and seats in an annular space 92 defined between outer surface 94 of the stem portion 68 and inner surface 96 of the cylindrical wall 78.

The inner/rearward part 32 is typically molded such that the mold separation is around an outer edge 98 of the annular flange 80 which has a diameter less than the inner diameter of the cylinder 14 in the trigger sprayer body 12. As a result, any flashing 99 will not affect the operation of the piston body 28.

The annular flange 80 has a forwardly facing surface 102 that faces the free end surface 56 of the outer cylinder of the first part 30 and, together with a portion of outer surface 104 (which also abuts surface 85) of the cylindrical wall 78 form the unobstructed annular space 36. This unobstructed annular space 36 is formed to receive the O-ring 34 as best shown in FIG. 3A.

The outer/forward part 30 can be made of polypropylene and the inner/rearward part 32 can be formed of a polyester resin, of polypropylene or any other material compatible with the fluid to be dispensed.

The O-ring 34 is preferably formed of buna-n, a nitrile rubber or of viton, another rubber. It is to be understood that the O-ring 34 can be made of other materials such as, for example, PTFE. Rubber, however, is preferred since it provides more flexibility that enhances the sealing of the O-ring 34 against an inner wall surface 106 of the cylinder 14. Empirical tests have shown that the piston assembly 27 described above provides very good sealing and can be used with all kinds of liquids.

Figure 3B:
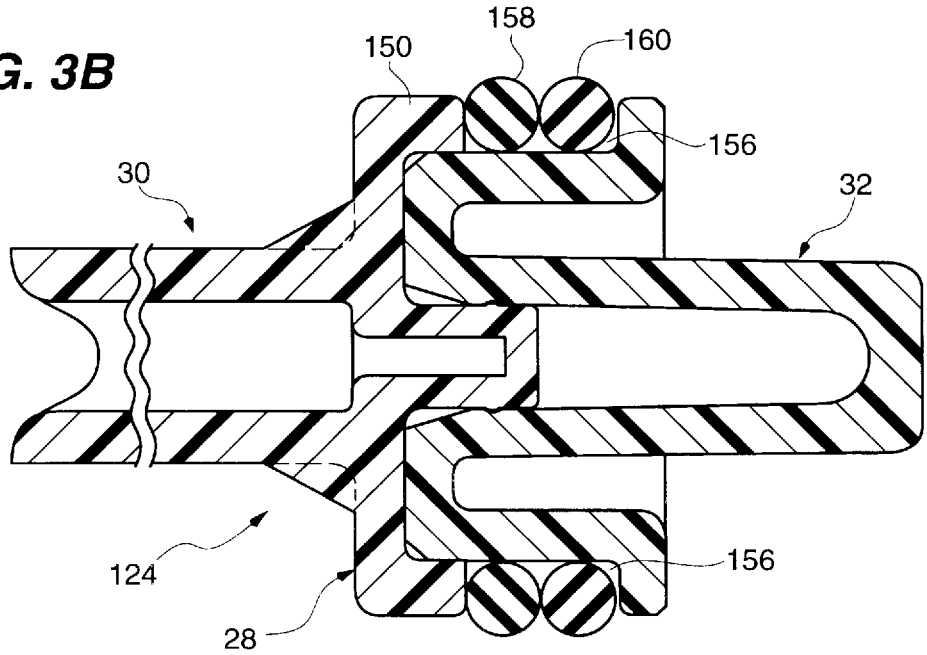
FIG. 3B is a modified version of the piston assembly shown in FIG. 3A and shows the piston assembly as including two O-rings in an unobstructed annular space in a piston body.

In FIG. 3B there is shown another embodiment of the piston assembly 27, namely piston assembly 124, which is substantially identical to the piston assembly 27 shown in FIG. 3A with the exception that the length of an outer cylinder 150 is shorter so as to provide a wider unobstructed annular space 156 for receiving two O-rings 158 and 160. The provision of two O-rings 158 and 160 enables the two O-rings 158 and 160 to serve as a seal for sealing a vent opening 164 (FIG. 2) extending between the cylinder 14 and a cylindrical cavity 170 within the trigger sprayer body 12 which communicates with another vent opening 172 through an insert member 174 that is received within the cap 20 and spin welded to the body 12 at the lower end 22 thereof.

From the foregoing description, it will be apparent that the piston assembly 27 or 124 of the present invention comprising a piston body 28 having an unobstructed annular space 36 or 156 and an O-ring 34 or 158 and 160 received in the unobstructed annular space provides a simpler and less expensive piston assembly for mounting in a cylinder of a trigger sprayer body and which is capable of being used with all kinds of liquids, including cleaning liquids.

Further, it will be apparent from the foregoing description that modifications can be made to the piston assembly 27 or 124 without departing from the teachings of the invention.

Also, it will be understood that in a preferred embodiment of the piston assembly 27 or 124 of the present invention, two parts 30 and 32 are provided which, when pressed together, form an unobstructed annular space 36 or 156 for receiving and holding an O-ring 34 or 158 and 160 on the assembly 27 or 124.

Also, it will be understood that the piston assembly of the present invention can be provided with one 34 or two O-rings 158 and 160, the two O-rings 158 and 160 being preferred when it is necessary to seal a vent opening 164 that extends through the wall of the cylinder 14 for venting a container to which the trigger sprayer 10 is connected.

Accordingly, the scope of the present invention is only to be limited as necessitated by the accompanying claims.

I claim:

1. In a trigger sprayer comprising a trigger sprayer body having a cylinder therein, a trigger movably mounted to the trigger sprayer body for engaging and moving a piston against a spring in the cylinder, the improvement residing in a piston assembly including a piston body having an unobstructed annular space for receiving an O-ring and an O-ring mounted in said unobstructed annular space for sealing between said piston body and an inner wall in the cylinder in the trigger sprayer body, said piston assembly comprising an outer/forward part, an inner/rearward part press-fittingly connected to said outer/forward part thereby to form said unobstructed annular space therebetween and said O-ring being received in said unobstructed annular space formed between said parts, and said outer/forward part including a stem Portion extending forwardly from said outer/forward Part and defining a piston rod portion for engaging the back side of the trigger.

2. The piston assembly of claim 1 wherein said outer/forward part includes a cup-shaped formation, said stem portion extending forwardly from a bottom surface of said cup-shaped formation and defining said piston rod.

3. The piston assembly of claim 1 wherein said O-ring is made of a nitrile rubber.

4. The piston assembly of claim 1 wherein said O-ring is made of a polytetrafluoroethelyne.

5. The piston assembly of claim 1 wherein said outer part is made of polypropylene.

6. The piston assembly of claim 1 wherein said inner part is made of a polyester resin, polypropylene, or any other material compatible with the fluid to be dispensed.

7. The piston assembly of claim 2 wherein said cup-shaped formation comprises a generally circular diametrically extending wall having said piston rod portion extending from a forward surface thereof and an outer cylinder extending from a rear surface of said diametrically extending wall at an outer periphery of said cup-shaped formation.

8. The piston assembly of claim 7 wherein said cup-shaped formation includes a small cylinder extending rearwardly from said rear surface of said diametrically extending wall.

9. The piston assembly of claim 8 wherein said small cylinder is co-axial with said outer cylinder and extends approximately the same distance as said outer cylinder from said rear surface of said diametrically extending wall.

10. The piston assembly of claim 7 wherein said inner/rearward part has a generally mushroom shape including a stem portion and a cup-shaped cap portion and said cap portion being received in said cup-shaped formation.

11. The piston assembly of claim 10 wherein said cap portion is press fitted with an interference fit into said cup-shaped formation.

12. The piston assembly of claim 10 wherein said cap portion has a radially outwardly extending flange at an inner, annular end of said cap portion and said annular space is defined between a forwardly facing surface of said annular flange, a portion of an outer periphery of said cap portion and a rearwardly facing annular end surface of said outer cylinder.

13. The piston assembly of claim 10 wherein said stem portion of said inner/rearward part extends rearwardly beyond an inner end surface of said cap portion and defines with an inner surface of said cap portion, an annular space for receiving a spring and said stem portion defines a guide post for the spring.

14. The piston assembly of claim 13 wherein said outer forward part has a centrally located small cylinder extending rearwardly from a rear surface of said diametrically extending wall and said cap portion and stem portion of said inner/rearward part have a cylindrical cavity for receiving said small cylinder.

15. The piston assembly of claim 14 wherein said small cylinder is received into said cylindrical cavity snap-fittingly.

16. In a trigger sprayer comprising a trigger sprayer body having a cylinder therein with a vent port through a wall of said cylinder communicating said cylinder with the inside of a cap of a container, a trigger movably mounted to the trigger sprayer body for engaging and moving a piston against a spring in the cylinder, the improvement residing in a piston assembly including a piston body having an unobstructed annular space for receiving two O-rings and two O-rings mounted in said unobstructed annular space for sealing between said piston body and an inner wall in the cylinder in the trigger sprayer body and said two O-rings being positioned in said unobstructed annular space and straddling said vent port in said cylinder when said piston is in an at rest position.

17. The piston assembly of claim 16 wherein said piston body is formed from two parts which are pressed together to form said unobstructed annular space between said parts for receiving said O-ring.

* * * * *